United States Patent [19]

Bréhéret et al.

[11] 4,060,048

[45] Nov. 29, 1977

[54] MECHANICAL COUPLINGS FOR PONTOONS AND SIMILAR FLOATABLE UNITS

[75] Inventors: Michel Francois Bréhéret, Le Fresne sur Loire; Andre Raphael Wambergue, Daon; Andre Jacques Carpentier, Paris, all of France

[73] Assignee: Ateliers Breheret S.A.R.L., St. Georges-sur-Loire, France

[21] Appl. No.: 749,765

[22] Filed: Dec. 13, 1976

[30] Foreign Application Priority Data

Dec. 19, 1975 France ..... 75.39894

[51] Int. Cl.[2] ..... B63B 35/38

[52] U.S. Cl. ..... 114/266; 114/77 R; 114/249

[58] Field of Search ..... 114/266, 249, 77 R, 114/28, 263

[56] References Cited

U.S. PATENT DOCUMENTS

| | | | |
|---|---|---|---|
| 2,431,039 | 11/1947 | Harrison | 114/77 R X |
| 2,605,733 | 8/1952 | Smith | 114/77 R X |
| 3,221,696 | 12/1965 | Gardner | 114/266 |
| 3,614,938 | 10/1971 | Statile | 114/249 X |
| 3,691,974 | 9/1972 | Seiford et al. | 114/266 |

*Primary Examiner*—Stephen G. Kunin
*Assistant Examiner*—Gregory W. O'Connor
*Attorney, Agent, or Firm*—Alter and Weiss

[57] ABSTRACT

A mechanical coupling for connecting together two buoyant members, such as pontoons, to make a buoyant structure. The mechanical coupling comprises vertical grooves in the pontoons. A pair of spaced apart plates partially cover the edge of the grooves. A key member in the shape of an I-beam fits with its web between the plates of a pair of pontoons so that its flanges hold the two pontoons together. Wedge shaped members attached to the I-beam and to the plates further act to wedge and lock the pontoons together as a unit.

8 Claims, 8 Drawing Figures

FIG. 1
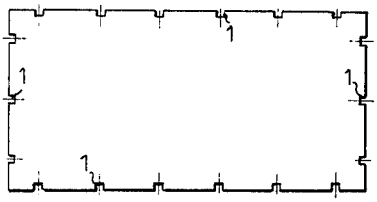
FIG. 3
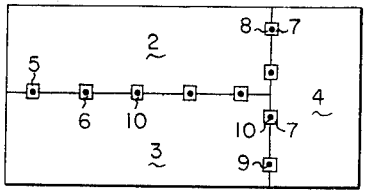
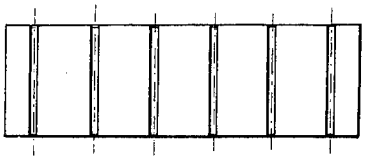
FIG. 2
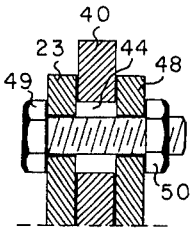
FIG. 7
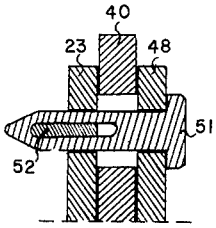
FIG. 8
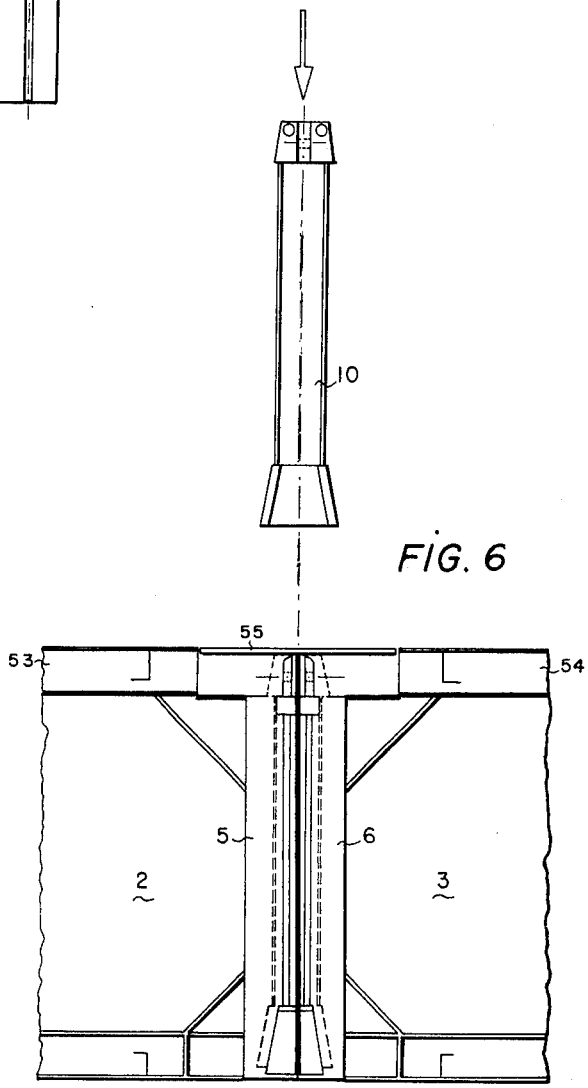
FIG. 6

MECHANICAL COUPLINGS FOR PONTOONS AND SIMILAR FLOATABLE UNITS

The present invention relates to a joining device utilisable for joining floating elements or separate pontoons in order to make platforms, bridges, rafts, boats, barges, ferry boats and the like, and to buoyant structures, structures including such devices.

Known floating elements or pontoons are transportable separately on lorries or railways wagons. They are placed in the water to be assembled edge-to-edge. For the assembly there may obviously be used hold members such as ropes, rings etc. However, there is preferably provided joining means specially adapted to pontoons. As a clear example in this field, there may be cited the methods or assembling devices described in French Pat. Nos. 1,225,623: 1,454,712; and 2,198,450.

More particularly there is described in U.S. Pat. No. 3,221,696 a joining device involving a key and grooves in which, in order to lower the key in the groove, it is indispensable for the pontoons to be brought together to the final assembling position. It is very difficult so to assemble two floating pontoons which are subject to the movement of the water. On the other hand, the mechanical play necessary for the passage of the key into the groove is prejudicial to the rigidity of the boats, barges or the like assembled from these floating elements.

In U.S. Pat. No. 2,431,039 there is described a joining device comprising a half wedge and a half-V. The structure of each groove is relatively complex. The connection between the two pontoons is only assured at the top points. The fixing of the half V on the half wedge is only assured by flanges. The pontoons are not joined at their lower parts. The result therefrom is that the rigidity of an assembly constituted by pontoons assembled by means of these joining devices, is very weak.

One object of the present invention consists in providing a joining device permitting of the assembly of pontoons with assembled lateral edge walls.

Another object of the invention in its preferred form consists in providing a joining device permitting of assembling two pontoons the adjacent, lateral edge walls of which are, on both sides of the device, placed flat without play one against the other.

Another object of the invention in its preferred form consists in providing a joining device in which the joining key between the two pontoons to be assembled is put in place by a simple vertical movement from top to bottom, the lowering of the key causing the alignment of the pontoons and keeping them together until its final putting in place.

Another object of the invention in its preferred form consists in providing a joining device which is sufficient practically to lift up to disengage the pontoons.

In particular, the assembly or the disengagement of the pontoons does not necessitate the use of pieces adapted to pivot round immersed axles.

According to the invention there is provided a joining device for use in connecting together two buoyant members, such as pontoons, to make a buoyant structure, said joining device comprising means defining two channel members and a joining member or key of I shaped section, said channel members each defining a slot in which the web portion of the joining member located in the assembled condition of the device so that the flanges of the key lie in the respective channels and the channel members are prevented by said flanges from being moved apart, the device being such that when assembled and extending upright, two inclined plates at the bottom of the key respectively engage and wedge together two trapezoidal half wedges respectively at the bottom of the channels and the tops of the channels are clamped together against opposite sides of a fastening plate which lies between the channels and is connected to the top end of the key.

Preferably the said slot of each channel is partly defined by two upper plates having holes therein which align with holes in the fastening plate in the assembled condition of the device so that the channels can be clamped together by bolts.

Preferably also, each slot of each channel is partly defined by guide plates extending between the half wedges and the upper plates.

Accordingly to another preferred feature the inclined plates form continuations of the flanges and are symmetrically inclined and the inclined plates are thicker than said flanges and are interconnected by a web extension plate forming a continuation of the web of the key.

According to another preferred feature the upper edges of the inclined plates of the key ride along the insides of the guide plates as the key is being moved downwards relative to the channels to the assembled position.

According to another preferred feature each slot is partly defined by a pair of bars located towards the top of the channel such that the bars of the respective channel in the assembled condition lie in face to face contact and a space is defined thereabove in which the fastening plate of the key lies, and preferably also the key has at the top end a hooking plate which forms a cross with the fastening plate and extends into the slots of the channels when the joining device is in the assembled condition. Also according to the invention there is provided a buoyant structure comprising at least two buoyant members adapted to be connected together edge-to-edge by one or more joining devices, as aforesaid, said buoyant members respectivaly defining the channels of the or each joining device, and the structure including a key for the or each joining device.

An embodiment of the invention will now be described, by way of example, with reference to the accompanying drawings, wherein:

FIG. 1 is a view from above of a pontoon according to the invention;

FIG. 2 is a side view of the pontoon of FIG. 1;

FIG. 3 is a view from above of several pontoons according to the invention assembled to form a floating structure;

FIG. 6 illustrates the assembly of two pontoons by the means illustrated in FIGS. 4 and 5;

FIG. 7 is a view in section of a clamping means used with the key shown in FIG. 5; and FIG. 8 is a view in section of a variation of the clamping means of FIG. 7.

Figure 4:
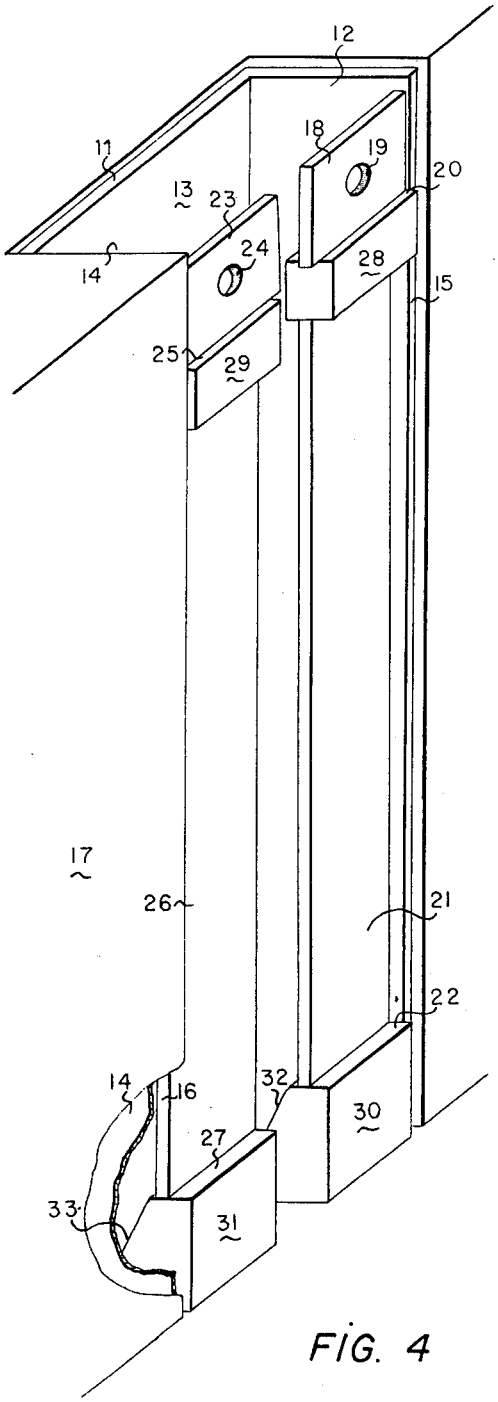
FIG. 4 is a perspective view of a groove of the pontoon shown in FIGS. 1 and 2.

The pontoon of FIG. 1 is of rectangular shape and has in its four vertical lateral edges grooves 1 of which one is shown in FIG. 2. Each groove 1 forms a part of a joining device according to the invention. As FIG. 2 shows, each groove 1 extends for the entire height of the pontoon.

FIG. 3 shows how three pontoons 2, 3 and 4 are assembled to constitute a floating unit. They are disposed so that the grooves 5 of the pontoon 2 are opposite the groove 6 of the pontoon 3 whilst the grooves 7 of the pontoon 4 lie opposite the grooves 8 and 9 of the pontoons 2 and 3 respectively. It must be understood that all the grooves 5 to 9 are identical with one another except possibly as regards their respective heights; they are of the type of groove 1 of FIGS. 1 and 2. FIG. 3 shows likewise that some lateral edges of the pontoons may not be provided without grooves if they do not participate in the assembly: It is not obligatory that the grooves be vertical but may, for example, be oblique.

In fact, as FIG. 3 shows diagrammatically, a joining device according to the invention comprises three parts; means defining two different pontoon grooves disposed opposite and a joining member or key 10 which is introduced into the well created by the two grooves in assembling the device.

The perspective view of FIG. 4 shows means defining a groove and such means comprises a gutter 11 open towards the outside of U section opened towards the outside and formed by three sheet metal plates 12, 13 and 14 welded along the vertical edge of the gutter. In addition, the gutter 11 is soldered to the remainder of the structure of the pontoon to form an integral part. In the example shown the three vertical edges 15 and 16 of the sheet metal plates 12 and 14 are slightly set back in relation to the plane of the wall 17 of the pontoon in which the groove is located. From top to bottom there are welded to the plate 12 a plate 18, pierced with a hole 19, a supporting piece 20, a high guide plate 21 and a half wedge 22 symmetrically there are welded to the plate 14 a plate 23 pierced with a hole 24, a supporting piece 25, a high guide plate 26 and a half wedge 27.

The supporting pieces 20 and 25 have a practically rectangular or square section with a thickness near to the height; they have obligatorily a flat vertical face 28 or 29 turned towards the inside; the faces 28 and 29 are both in the plane of the wall 17. Between the free ends of 20 and 25 there exists a gap or slot A the use of which will be described, in the following. The outer faces of the plates 18 and 23 are slightly set back in relation to the faces 28 and 29 by a distance B which will be defined in the following. The guide plates 21 and 26 are likewise set back in relation to the faces 28 and 29 and their surfaces turned towards the inside of the groove 1 are at a distance C from the plane of 28–29. The half wedges 22 and 27 have a trapezoidal vertical section each with a flat vertical face 30 or 31 in the plane of 28–29 and faces 32 and 33 inclined towards the inside of the groove. The inclined faces 23–33 define, with their vertical faces 30–31 an angle X at the top of half wedge.

Figure 5:
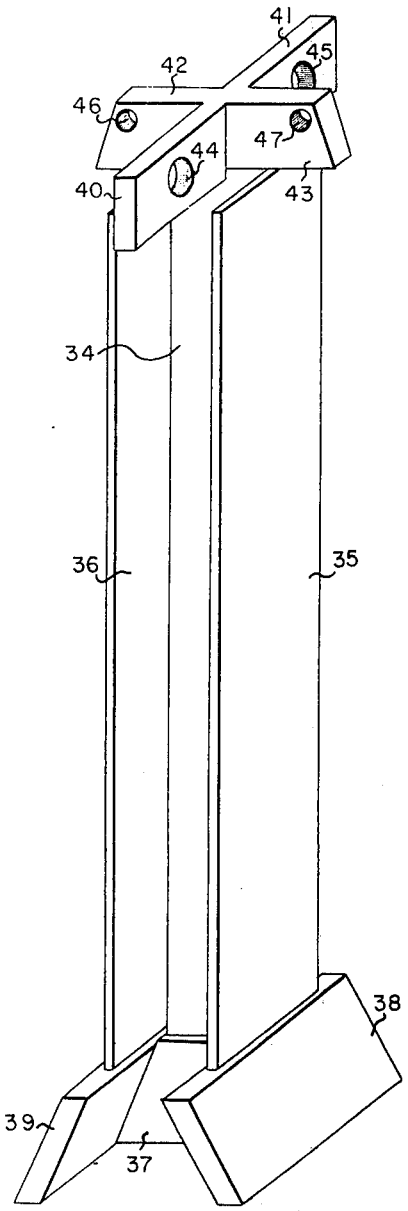
FIG. 5 is a perspective view of a key for joining pontoons according to FIG. 1 together in the manner shown in FIG. 3.

The various pieces 18, 20, 21, 22, 23, 25, 26 and 29 have their edges adjacent to the sheet plates 12 and 14 welded to the latter; they are welded to one another; furthermore, the solid pieces such as 22 and 27 are also welded to the sheet metal plates 12 and 14 by means of gold plugs. The key of FIG. 5 has a vertical I shaped beam formed by the web 34 and the two flanges 35 and 36. The web 34 of the beam is extended towards the bottom by a cross plate 37 of trapezoidal shape whilst the two plates 38 and 39 are welded perpendicularly to the inclined edges of the plate 37. The plates 38 and 39 have their upper edges welded to the bottom of the flanges 35 and 36. The web 34 of the beam is extended towards the bottom by a cross plate 37 of trapezoidal shape whilst the two plates 38 and 39 are welded perpendicularly to the inclined edges of the plate 37. The plates 38 and 39 have their upper edges welded to the bottom of the flanges 35 and 36 but are substantially wider and thicker that these latter. Likewise the plate 37 is thicker than the web 34. The plates 38 and 39 define a dihedral with horizontal edge, the angle of which is practically equal to 2X.

The key also has mounted above the I shaped beam a head in the form of a cross formed by two branches 40 and 41 parallel to flanges 35 and 36 on the one hand, and two branches 42 and 43 perpendicular to flanges 35 and 36 on the other hand. The branches 40 and 41 have a thickness equal to 2B and each has a hole 44 or 45 preferably made oval adapted to be placed respectively opposite the holes 24 and 19. Finally, the branches 42 and 43 have a thickness less than A and each has a hole 46 or 47 used for the handling of the key. It is to be noted that the distance between each face of the branch 40 or 41 and the inner face of a flange 35 or 36 is slightly greater than the thickness of the piece 20 or 25.

FIG. 6 permits now of understanding how the joining of the two pontoons 2 and 3 is realised by utilising a key pin according to the invention. The two pontoons are brought together so that their grooves 5 and 6 are facing. If it is assumed that the grooves shown in FIG. 4 is symmetrical with the groove 5 about the plane of 17. The key 10 suspended on a lifting apparatus (not shown) by the holes 46 and 47 is lowered into the grooves so that the plate 39 is on the inside of the groove 5 in relation to the plates 18 and 23 and the plate 38 is on the inside of the groove 6 in relation to the symmetrical plates and the plate 37 passes respectively between 18 and 23 and the symmetrically located plates on the other hand. The key 10 descends and the flanges 36 and 35 pass inside the grooves as far as 39 and 38, whilst the web 34 follows the plate 37. It appears then that the key 10 prevents the moving away of the pontoons throughout its descent, keeping the guide plates 26 and 21 as well as the symmetrically arranged components between the flanges 36 and 35 of the key. At the end of the course of movement the plates 39 and 38 cover the half wedges 27 and 22 clamping them against the symmetrically arranged faces 31 and 30 being applied against those of the half wedges of the groove 5. To ensure a good camping of the half wedges of the two grooves between one another the cross shaped head of the key is struck by means of a tool or suitable member. The clearance between the two pontoons at the immersed base is thereby eliminated.

It will be seen that the plates 40 and 41 are practically located between the plates 23 and 18 and the symmetrically arranged components the faces 29 and 28 of 25 and 20 being in contact with the corresponding faces of the parts of the groove 6. It then suffices as FIG. 7 shows, to clamp 23, 40 and 48, the component arranged symmetrically to 23 by means of a bolt of high resistance passed into the holes 24 and 44 (the same is of course done for 18, 41 and the symmetric of 18). The high resistance bolt 49–50 obviates any sliding between 23, 40 and 48. The hole 44 is made oval to take into account the variable driving in of the key 10 is respect of the grooves. It should be noted that if a clearance between the pontoons is found it suffices to unscrew the bolt and drive the key a little more in order to remove this clearance the bolt being then put in place again.

FIG. 8 shows a variation of clamping of the pieces 23, 40 and 48 in which a peg with the head 51 and a slotted pin 52 such as those employed on public works sites.

In FIG. 6 is likewise shown that the grooves 5 and 6 are in their upper parts 53 and 54 deeper than behind the guide plates 21 and 26 which permits of providing clearance around the plates 18 and 23 for the tools to be utilised for example to tighten the bolt 49–50. Finally, as the upper edge of the gutter 11 is slightly below the upper level of the floor on the pontoons, there may be located on these edges a paving stone serving as a cover such as 55, FIG. 6.

It should be noted that the described device is of very convenient use. In fact, the key 10 is guided in the course of its descent on the one hand by the guide plates 21 and 26 against the flanges 36 and 35 and on the other hand by the free edges of 21 and 26 against the web 34. It is therefore not necessary to use divers to secure the joining of the pontoons below the level of the water. In case of this connection of the pontoons, a lifting device permits of withdrawing the key.

In addition when two pontoons are assembled by means of several devices the final clampings may only be effected once all the keys are practically descended. It is also to be noted that the joining devices according to the invention permit of disengaging the pontoons once they have been placed for conventional use in the technology.

The joining devices permit also of assembling pontoons of difficult heights, that is to say the grooves of which have different heights. It suffices to displace in height one wedge relative to another, a longer cross piece 37 keeping them connected to one another.

It should also be noted that the joining devices of the invention may be utilised with pontoons of any size in particular with pontoons of the toy type permitting children to assembly boats.

The pontoons may of course be self propelling or not and may have wells for the installation of engines etc.

In the preceding description it has been assumed that the lateral walls of the pontoons are vertical but it must be understood that the joining devices may be utilised with inclined walls for assembly when the pontoons have these. Although the principles of the present invention have been described above in relation to one particular embodiment it must be understood that the said description has only been given by way of example and does not limit the scope of the invention.

What is claimed is:

1. A joining device for use in connecting together buoyant members, such as pontoons, to make a buoyant structure, said joining device comprising channel means on each of said buoyant members, I shaped section key means for cooperating with said channel means on each of said buoyant members to connect said buoyant members together, said I shaped section including spaced apart flange sections separated by a web section, said channel means defining a slot in which the web sections of the key means locates in the assembled condition of the device so that the flange sections of the key means lie in the respective channel means and the channel means are prevented by said flange sections from being moved apart, and said key means further including two inclined plates at the bottom of the flange sections of said key means, two trapezoidal half wedges respectively at the bottom of the channels for engaging and wedging together with said inclined plates.

2. A joining device according to claim 1 wherein said key means includes fastening plate means, said fastening plate means having holes therein, and wherein the said slot of each channel is partly defined by two upper plates having holes therein which align with holes in the fastening plate means in the assembled condition of the device so that the channel can be clamped together by bolts.

3. A joining device according to claim 2 wherein each slot of each channel is partly defined by guide plates extending between the half wedges and the upper plates.

4. A joining device according to claim 1 wherein the inclined plates form continuations of the flanges and are symmetrically inclined.

5. A joining device according to claim 4 wherein the inclined plates are thicker than said flanges and are interconnected by a web extension plate forming a continuation of the web of the key means.

6. A joining device according to claim 4 wherein the upper edges of the inclined plates of the key ride along the insides of the guide plates as the key is being moved downwards relative to the channels to the assembled position.

7. A joining device according to claim 2 wherein each slot is partly defined by a pair of bars located towards the top of the channel such that the bars of the respective channels in the assembled condition lie in face to face contact and a space is defined thereabove in which the fastening plate of the key means lies.

8. A joining device according to claim 2 wherein the key means has at the top end a hooking plate which forms a cross with the fastening plate and extends into the slots of the channels when the joining device is in the assembled condition.

* * * * *